US006739937B2

(12) United States Patent
Snelson

(10) Patent No.: US 6,739,937 B2
(45) Date of Patent: May 25, 2004

(54) SPACE FRAME STRUCTURE MADE BY 3-D WEAVING OF ROD MEMBERS

(76) Inventor: Kenneth D. Snelson, 37 W. 12th St., Apt. 12J, New York, NY (US) 10011

( * ) Notice: Subject to any disclaimer, the term of this patent is extended or adjusted under 35 U.S.C. 154(b) by 32 days.

(21) Appl. No.: 10/133,259

(22) Filed: Apr. 24, 2002

(65) Prior Publication Data

US 2002/0123293 A1 Sep. 5, 2002

Related U.S. Application Data

(63) Continuation-in-part of application No. 09/745,353, filed on Dec. 21, 2000, now abandoned.

(51) Int. Cl.[7] ..... A63H 33/10
(52) U.S. Cl. ..... 446/107; 446/119
(58) Field of Search ..... 446/85, 87, 106, 446/107, 111, 116, 119, 105, 108, 120, 122, 476, 478

(56) References Cited

U.S. PATENT DOCUMENTS

| | | | | |
|---|---|---|---|---|
| 3,422,565 A | | 1/1969 | Kentfield | 446/102 |
| 3,546,049 A | * | 12/1970 | Kostich | 52/650.2 |
| 3,796,004 A | * | 3/1974 | Auerbach | 446/107 |
| 3,830,011 A | | 8/1974 | Ochrymowich | 446/126 |
| 3,998,003 A | | 12/1976 | Rosenaum | 446/119 |
| 4,069,832 A | | 1/1978 | Bingham | 135/3 R |
| 4,259,790 A | | 4/1981 | Borisof | 434/81 |
| 4,309,851 A | | 1/1982 | Flagg | 52/2 |
| 5,430,989 A | | 7/1995 | Jones | 446/122 |
| 5,785,529 A | | 7/1998 | Hearn et al. | 434/211 |

* cited by examiner

*Primary Examiner*—Jacob K. Ackun, Jr.
(74) *Attorney, Agent, or Firm*—Winston & Strawn LLP

(57) ABSTRACT

The invention relates to a toy construction kit comprising a plurality of elongated rod members of different lengths; and a plurality of joining members. Each joining member is configured and dimensioned to be capable of connecting at least three rod members together around a common vertex point in a weave pattern such that the rods do not pass through the vertex point but are oriented about it in a clockwise or counter-clockwise arrangement. At least some and preferably all rod members are formed with a zig-zag configuration to avoid bending the rod members at vertex points. After making a structure by weaving the rod members and temporarily or permanently connecting them with the joining members, unique and original space frames are obtained. These objects form another embodiment of the invention.

19 Claims, 4 Drawing Sheets

SPACE FRAME STRUCTURE MADE BY 3-D WEAVING OF ROD MEMBERS

CROSS-REFERENCE TO RELATED APPLICATION

This application is a continuation-in-part of U.S. application Ser. No. 09/745,353 filed Dec. 21, 2000 now abandoned.

BACKGROUND ART

The invention relates to a construction kit useful as an educational or amusement device for building three dimensional geometric forms.

Numerous applications have been found for the natural geometries of three dimensional grids or frames that can be constructed from various materials using connector nodes. These include the familiar TINKER-TOY kits, as well as massive office buildings that are constructed with huge "I" beams that are welded or riveted together. Most of these are rectilinear designs with floor planes defining the X and Y axes with the vertical beams defining the Z axis of standard cubical geometry.

In other cases, architectural structures have applied the geometry of related tetrahedra and octahedra. Other polyhedra such as the rhombic dodecahedron and the terakaidecahedron are less frequently used in architecture even though they are capable of forming architectural space frames.

In constructing such forms, various methods have been used for attaching elongate beams to obtain the desired space frames. Cast, machined or riveted joints have been devised to meet the exact required angles of the particular geometry.

Many varieties of toy building kits exist for constructing these and other spatial forms; some use nodes and sticks; some use molded shapes that fit one to another; others use magnets for attaching parts together. While all these appeal to the public in general, there remains a need for additional, more challenging, kits which are capable of making novel and unusual three dimensional space frames objects. The present invention now provides kits that utilize a different construction method to create such objects to satisfy this need.

SUMMARY OF THE INVENTION

The invention relates to a toy construction kit comprising a plurality of elongated rod members of different lengths; and a plurality of joining members. Each joining member is configured and dimensioned for connecting at least three rod members together around a common vertex point in a weave pattern such that the rods pass by but do not pass through the vertex point and are oriented about the vertex point in a clockwise or counter-clockwise arrangement. After making a structure by weaving the rod members about the vertex point(s) and connecting them with the joining members, unique and original three dimensional space frame objects are obtained.

The joining members can connect the rod members in a temporary or permanent fashion so that the resulting three dimension space frame object can be either taken apart for future use of the kit, or permanent objects can be made for display. For temporary connection, the joining members may be elastic bands or cords, while for permanent construction, clay, a plastic part configured to receive the rod members in the desired orientation and arrangement about the vertex point, an adhesive, or combinations thereof, can be used.

Advantageously, at least six rod members and at least three joining members are present and positioned such that each joining member connects at least three rod members about a vertex point and at least three different vertex points are present to form at least one twist polyhedron in the space frame object. In one embodiment, at least four joining members are present, each connecting three rod members at each of at least four different vertex points to form at least one twist-tetrahedron. In another embodiment, at least six joining members are present, each connecting four rod members at each of at least six different vertex points to form at least one twist octahedron. The kit contains at least eighteen rod members and at least sixteen joining members such that at least four to twelve twist polyhedra can be formed in the space frame.

Preferably, the rod members are flexible and are substantially cylindrical. For some kits, at least some and preferably all of the rod members are formed with a zig-zag configuration to avoid bending the rod members at vertex points. When making space frames, at least one rod member extending from each vertex point is connected to at least two other rod members at another vertex point by at least one additional joining member, preferably with at least 20 to 25% of the total number of rod members extending from a vertex point in the space frame object being connected to at least two other rod members at each of at least two additional vertex points by at least one joining member at each additional vertex point to form multiple twist polyhedra in the space frame object.

The three dimensional space frame objects formed from the elongated rod members and joining members of the toy construction kit which are connected as described herein form yet another embodiment of the invention.

BRIEF DESCRIPTION OF THE DRAWINGS

Preferred embodiments of the invention can be understood from the following detailed description which is to be read in conjunction with the appended drawing figures, wherein.

DETAILED DESCRIPTION OF THE PREFERRED EMBODIMENTS

This invention is a simple and economical building toy that requires only cut lengths of reed, cane, metal, plastic or other similar flexible rod-like materials plus joining members of rubber bands, wrapping filament clay, plastic parts, and/or adhesives. The invention is based on weaving, permitting the rods to be woven in particular configurations about a vertex point to develop frames in three-dimensional space. By assembling these rod members in special ways from a kit, the player is tested to solve a puzzle and to be rewarded by creating a woven space frame. Depending upon the type of joining member used, the space frame can be temporarily constructed and then disassembled for future use, or a more permanently constructed object can be created for display or exhibition.

Figure 1:
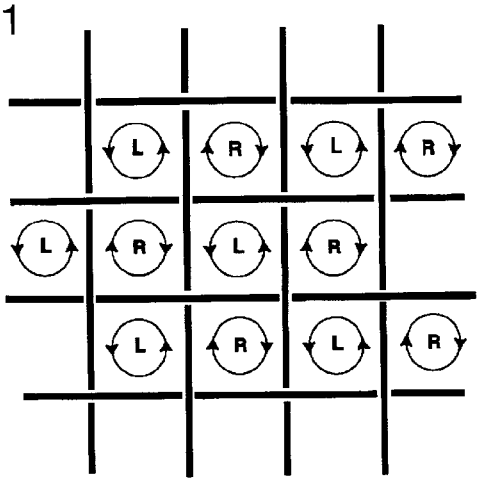
FIGS. 1 and 2 are schematic views of two known weaving patterns according to the prior art.
Figure 2:
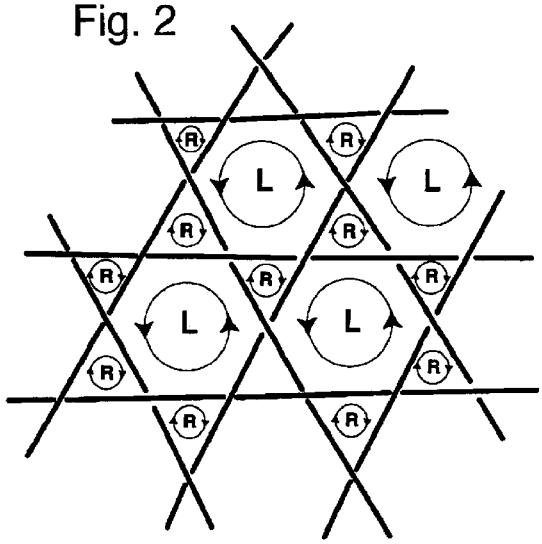

FIGS. 1 and 2 are schematic views of two basic weaving systems of prior art. For a proper description of this invention, it is useful to review the underlying principles of these weaving systems as they are applied in the construction of space frames using the rod members and joining members of my kits.

FIG. 1 shows a section of a standard square-weave. Within each square unit a circle with arrows identifies its helical sense, and weaving can be accomplished in a clockwise or counter-clockwise manner. The helixes of adjacent squares alternate or checkerboard clockwise and counter-clockwise to form the final woven pattern.

FIG. 2 shows a three-way weave with its pattern of alternating triangles and hexagons. The arrows identify the helical sense of each polygon. These hexagons are woven in counter-clockwise helixes while the triangles are woven in clockwise helixes. The weave, of course, can be arranged to reverse this order with clockwise hexagons and counter-clockwise triangles.

Although these two methods, i.e., 2-way and 3-way weaving, have endless variations, crisscrossing, doubling or skipping, the fundamental structures are unique and represent the essence of the art of weaving. While it does not matter whether a clockwise or counter-clockwise weave direction is used, it is necessary to arrange all vertexes in a single space frame with the same weave direction. The particular weave direction can be easily selected by the user depending upon the type of space frame that is to be constructed. This invention provides the instruction and means to spatially engage and superimpose these basic planar weaves using rod members and joining members in such a way as to produce unique three-dimensional space frames and related objects.

There are two types of three-way weaving employed in the invention and each one produces a distinctly different form of space frame. Type-1, as shown in FIGS. 3, 4, 5 and 6, produces a matrix of tetrahedra alternating with truncated tetrahedra. Type-2 produces a space frame of octahedra, one of which is shown in FIG. 8, alternating with cuboctahedra as shown in FIGS. 9, 10, 11, 12 and 13.

Figure 5:
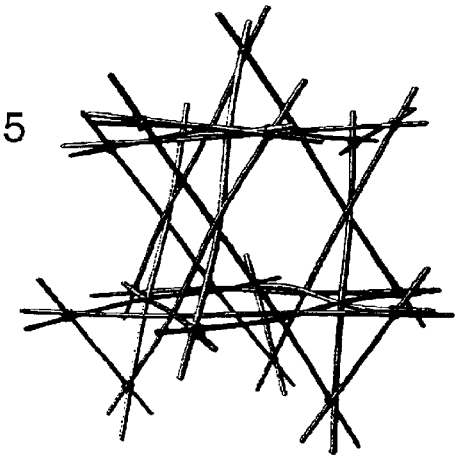
FIGS. 5 and 6 are schematic illustrations of more complex space frames made of a plurality of the twist tetrahedra shown in FIG. 3.
Figure 6:
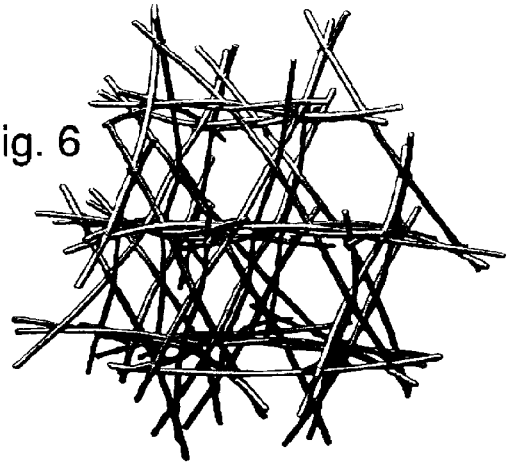

It should be noted that the rod members in FIGS. 3, 4, 9, 10, 11, and 12 have been truncated or cropped for clarity in those figures. Of course, one of ordinary skill in the art would immediately recognize that the present space frames can be created using longer rod members with the length of such rod members being sufficient to engage distant or additional modules as called for by the kit. When building a space frame from the kit, the builder will initially choose the longer rod members, i.e., the ones that will eventually engage adjacent or outer modules. More complex Type-1 space frames are shown in FIGS. 5–6 while more complex Type-2 space frames are shown in FIGS. 10–13.

The kit is formed by providing a number of rod members of different lengths. Generally, about 25 to 50 rod members are provided in a small kit, with about 100 to 150 rod members being provided in a larger kit. An appropriate number of joining members are provided to enable the user of the kit to prepare space frames utilizing some or all of the rod members. Generally, about the same number of joining members and rod members are provided, with 25 to 50 in the smaller kits and 100 to 150 in the larger kits. For most space frame objects, a slightly smaller number of joining members is required compared to the number of rod members, with the difference being extra ones being present in case some joining members break or become lost from the kit.

Figure 3:
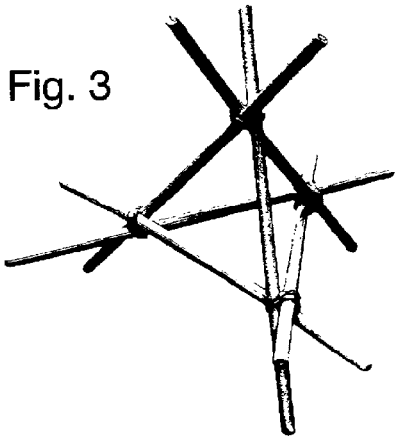
FIG. 3 is an illustration of a three dimensional space frame made of a twist-tetrahedron made using the rod members and joining members from a kit according to the invention.
Figure 3A:
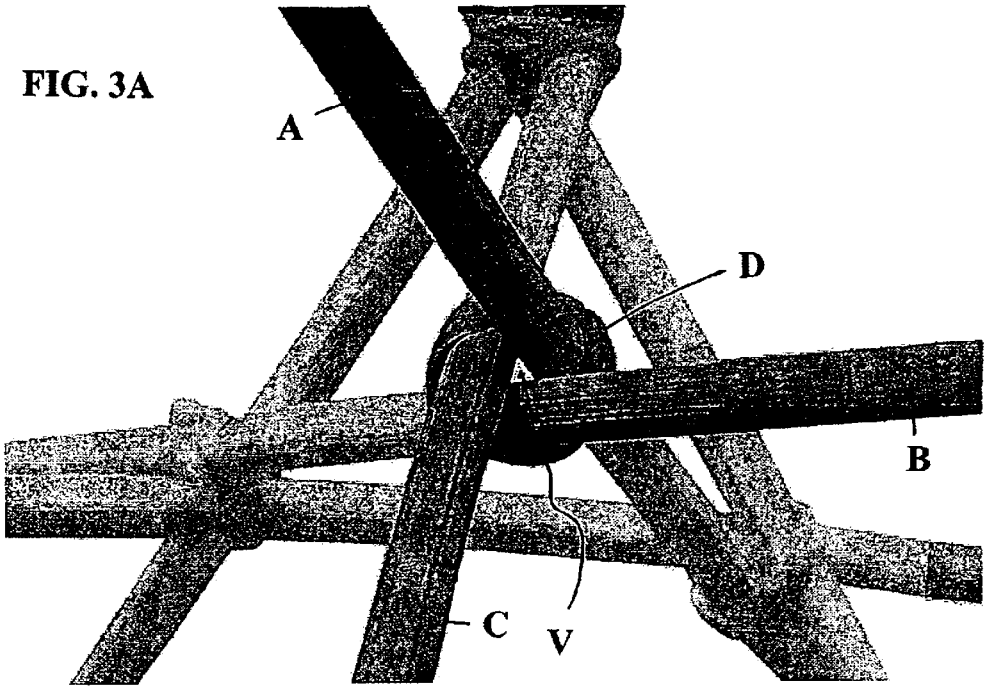
FIG. 3A is an illustration of a vertex point made from three rod members and a joining member.

FIG. 3A illustrates a vertex point V made by weaving three rod members A, B, C about that point and then securing the rods together by an elastic member D. The rods are woven in a clockwise direction with rod member A passing over rod member B and with rod member B passing under rod member C. As shown, the rods extend past the vertex point V but not through it. Four of these vertex points are shown in the twist tetrahedron of FIG. 3.

Figure 8A:
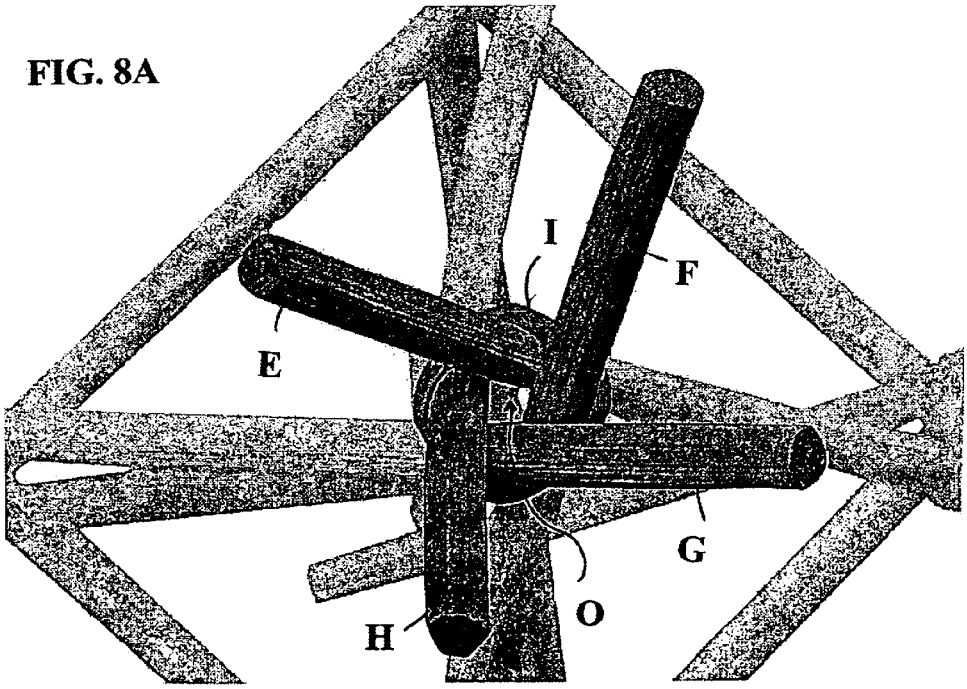
FIG. 8A is an illustration of a vertex point made from four rod members and a joining member.
Figure 8:
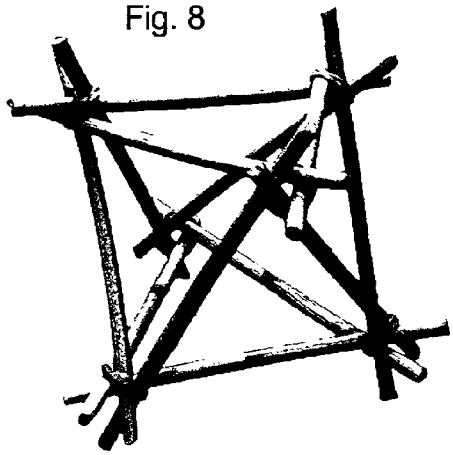
FIG. 8 is an illustration of a twist-octahedron made using the rod members and joining members from another kit according to the invention.

FIG. 8A illustrates a vertex point O made by weaving four rod members E, F, G, H about that point and then securing the rods together by an elastic member I. The rods are woven in a clockwise direction with rod member E passing over rod member F, rod member F passing over rod member G, rod member G passing under rod member H, and rod member H passing under rod member E. As shown, the rods extend past the vertex point O but not through it. Six of these vertex points are shown in the twist octahedron of FIG. 8.

The rod members can have any cross-sectional configurations, such as circular, oval, rectangular, square, etc., but a cylindrical design is preferred. All rod members in the kit can be made of a single color for uniformity or of multiple different colors. The lengths can be random or based on multiples of a predetermined length. For kits intended to be used by younger children, the rod members can contain markings to show where vertexes should be made. Again, a sufficient number are provided to create the desired space frame object. Also, the ends of the rod members can be designed to receive an end of another rod member so that longer lengths can be assembled, if desired.

To create three dimensional objects, a first step is to construct a module of the space frame, a kind of simple structure that here will be generally called a "twist-polyhedron", with specific illustrations made of a Type-1 "twist-tetrahedron" in FIG. 3 and a Type-2 "twist-octahedron" in FIG. 8. Such figures are assembled from rods arranged with helical bypasses at each vertex. As noted above, the rod members do not pass through the vertex point, but instead are woven adjacent to each other about the vertex point. These simple constructions are the weave-modules which can be used to create the more complex space frames of FIGS. 4–6 and 10–14.

The rod members should be sufficiently flexible so that they can be bent, twisted or otherwise manipulated around the outer rod members at the vertex to form a weave joint. Plastic, metal or cane are all suitable for this purpose. When metal rods are used, lightweight metals such as aluminum, zinc and titanium, are preferred. When other metals or thicker plastics are used, the core of the rod members can be hollow to conserve weight and increase flexibility.

For certain kits, some of the rod members may be pre-formed with a zig-zag configuration to facilitate formation of the weave joints at the vertexes. This configuration would be that of a bent or twisted rod member, such as those depicted in FIGS. 3–6 and 9–13. All plastic or metal rods can be made with this configuration so that it will be easy for the builder to identify where the vertexes should be and to actually form a weave joint at those vertexes.

Initially the rod members of such modules must be secured at each vertex with a joining member. The joining members are shown in FIGS. 3–6 and 8–13 as elastic bands, but the other joining members disclosed herein could instead be used, if desired. String or cord, clay or plastic connectors are all suitable alternates. Combinations, such as clay and elastic bands or plastic connectors and adhesives, can be used to create more secure joints. As the weave modules are added the vertexes on the interior modules become self-stabilizing in that joining members are not required, but the outermost ones typically will require connection using joining members.

FIG. 3 shows a twist-tetrahedron constructed of six struts arranged to bypass one another via a clockwise helix at each of the four vertexes. Each vertex is tied or banded, as shown, to hold the object together.

Figure 4:
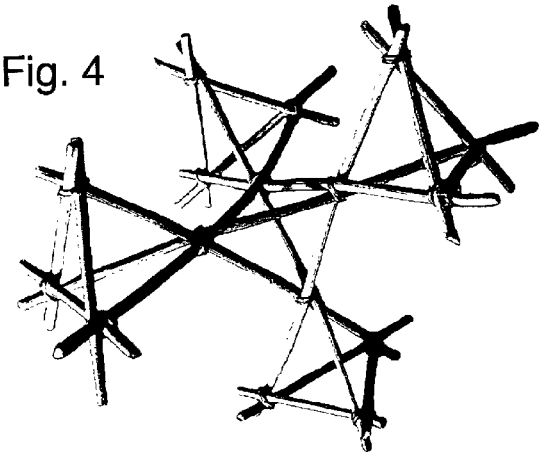
FIG. 4 is a schematic illustration of a three dimensional space frame made of four twist-tetrahedra arranged about one centrally located twist tetrahedron.

FIG. 4 shows a set of five twist-tetrahedra. The group is woven from a central twist-tetrahedron with its six edges extended and shared with four new identical neighboring tetrahedra. The vertexes here have clockwise helixes. A mirror structure would provide them with counter-clockwise helixes. Each exterior vertex is tied or banded, but the inner vertexes are self-fastening due to the contact pressure created by the warping of the rod members at each vertex.

Figure 7:
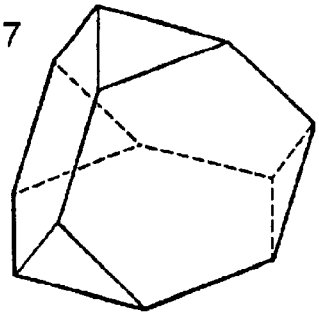
FIG. 7 is an illustration of a twist-truncated tetrahedron, the polyhedron that alternates spatially with the twist tetrahedra in the space frames of FIGS. 5 and 6.

FIGS. 5 and 6 are two views of extended Type-1 space frames according to the invention. Rubber bands are placed around only the outer vertexes. The inner vertexes are self-sustaining. A kit according to the invention can be limited to a few modules or extended with many modules depending on the size of the kit and the desired size of the space frame object to be created. FIG. 7 shows a twist truncated tetrahedron, the figure which alternates spatially with the twist tetrahedra in Type-1 space frames. If desired, another object, such as a toy, picture, sculpture, etc., can be arranged in this space with the space frame providing an aesthetically pleasing border that surrounds and highlights the other object. Colored rod members are particularly useful for this purpose.

FIG. 8 shows a module, a twist-octahedron of a Type-2 space frame constructed of twelve struts that bypass one another in a counter-clockwise helix at each of the six vertexes. Again, each vertex is tied or banded.

Figure 9:
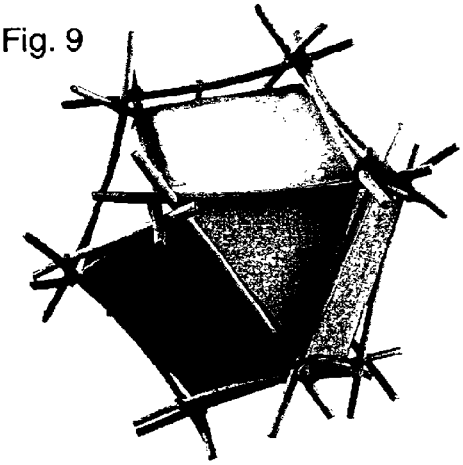
FIG. 9 is an illustration of twist-cuboctahedron with panels provided between the rod members to form a closed object.
Figure 14:
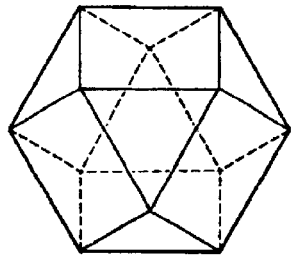
FIG. 14 is an illustration of a cuboctahedron that alternates spatially with the twist cuboctahedra in the space frames of FIGS. 11, 12 and 13.

FIG. 9 illustrates the twist-cuboctahedron that is provided with panels extending between the rod members on each face of the object. These panels enable a closed object to be provided, with the open space on the inside being available to contain other objects therein. FIG. 14 shows the configuration of the open space that is provided in this object. The panels can be made of cardboard, plastic or fabric, and can be permanently or temporarily attached to the rod members. When access to the interior of the object is desired, at least one of the panels can be removed to provide such access. The panels can be of the same color or of different colors, with all materials being the same or different depending upon the visual effect that is desired.

Figure 10:
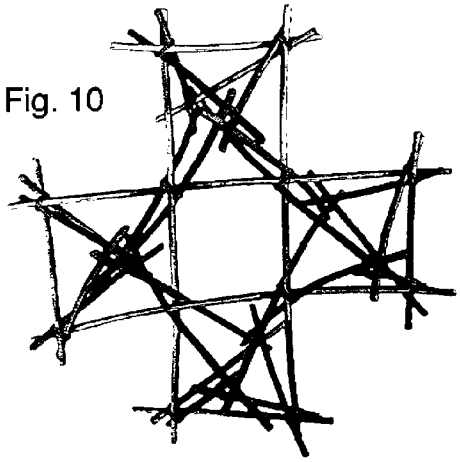
FIG. 10 is an illustration of four twist-octahedra of FIG. 8 joined together along common rod members.

FIG. 10 shows four twist octahedra joined in a woven linkage according to the invention. Again, elastic or rubber bands restrain the outer vertexes, while the inner vertexes are self-sustaining.

Figure 11:
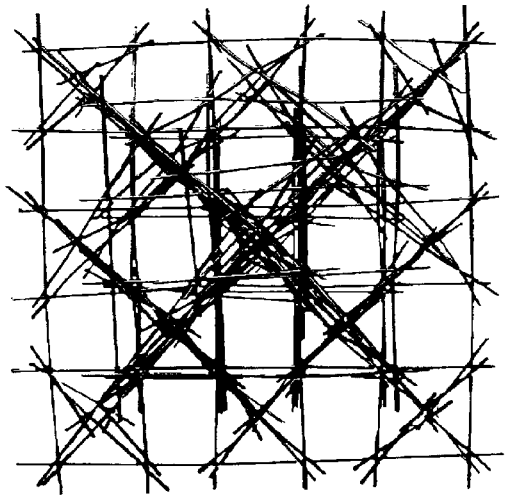
FIGS. 11, 12 and 13 are illustrations of extended space frames composed of twist octahedra and twist cuboctahedra made using the rod members and joining members according to the invention.

FIG. 11 shows a complex Type-2 space frame with alternating twist-octahedra and twist-cuboctahedra according to the invention. Each cuboctahedron is surrounded by eight octahedra at its triangular faces.

Figure 12:
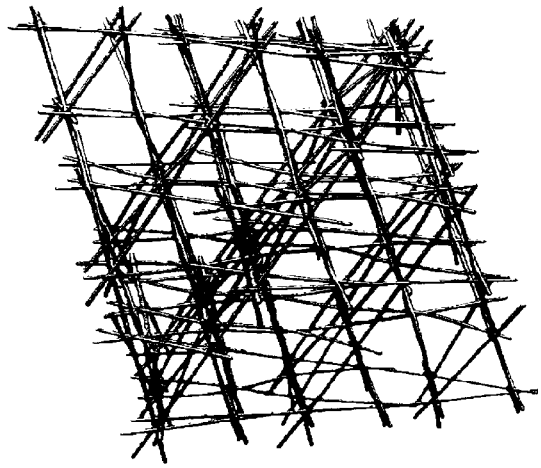
Figure 13:
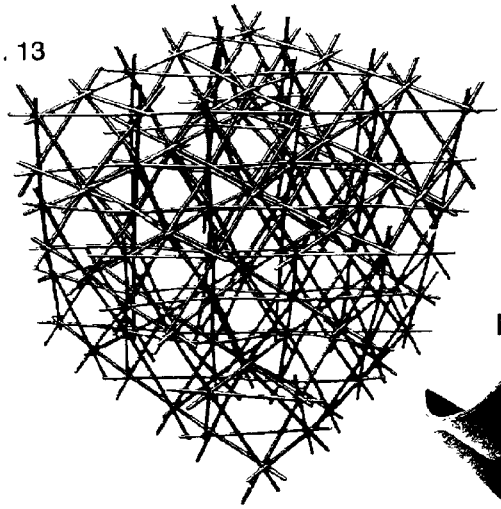

FIGS. 12 and 13 are different views of an extended space frame composed of twist-octahedra and twist-cuboctahedra according to the invention.

Figure 15:
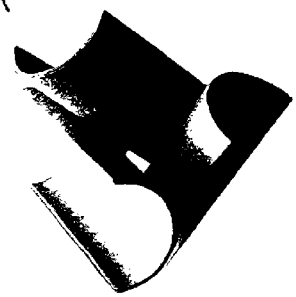
FIG. 15 is a perspective view of a plastic joining member for use in connecting the rod members to form joints in the twist tetrahedra of FIGS. 3 to 6.
Figure 16:
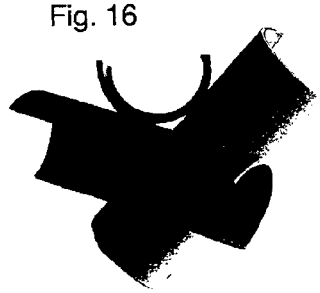
FIG. 16 is a front view of the joining member of FIG. 15.

FIGS. 15 and 16 show a molded plastic joining member that can be used in Type-1 space frames to connect the rod members at a vertex. This joining member is a simple connector that include three channels configured and dimensioned for securely receiving the rod members therein. Each channel shown in FIGS. 15 and 16 has a half circle cross section configured and dimensioned to receive part of a cylindrical rod member therein. Of course, the channels would be designed to match the configuration of the rod members.

These three channels are molded in a single piece with each channel being formed integrally with the others at the places where they are in contact.

To connect the rod members to the channels, a simple snap-locking insertion is all that is required. For certain kits, where more permanent objects are desired, a glue or other adhesive can be used to secure the rod member to the channel.

As shown, the central part of the connector is open, this defining the vertex point. This open area can receive string or cord to enable the space frame to be hung or suspended. Of course, it is not critical to have this open area and it does not have to be present in all connectors. It is contemplated that the kits of the invention would include some connectors having the open area and some without it. Since these connectors are made of molded plastic, they can be provided in any desired color. The preferred colors can be selected to match or complement those of the rod members. All connectors could be made of the same color or different colors can be provided.

Although not illustrated herein, a molded plastic joining member that can be used in Type-2 space frames to connect rod members would be of similar design except that it would include four channels for receiving the rod members.

While there has been shown and described what are considered to be preferred embodiments of the invention, it will of course be understood that various modifications and changes in form or detail could readily be made without departing from the spirit of the invention. It is therefore intended that the invention be not limited to the exact form and detail of these preferred embodiments nor to anything less than the true spirit and whole of the invention herein disclosed as hereinafter claimed.

What is claimed is:

1. A three dimensional space frame object formed from a toy construction kit comprising a plurality of elongated rod members of different lengths, and a plurality of joining members, each configured and dimensioned for connecting at least three rod members together around a common vertex point in a weave pattern such that the rods pass by but do not pass through the vertex point and are oriented about the vertex point in a clockwise or counter clockwise arrangement; wherein at least some of the plurality of elongated rod members and joining members are connected as defined above to form the object.

2. The three dimensional space frame object of claim 1 wherein the joining members comprise elastic bands or cords.

3. The three dimensional space frame object of claim 1 wherein the joining members comprise clay or a plastic connector configured to receive and hold the rod members in the desired orientation and arrangement about the vertex point.

4. The three dimensional space frame object of claim 1 wherein at least six rod members and at least three joining members are present and positioned such that each joining member connects at least three rod members about a vertex point and at least three different vertex points are present to form at least one twist polyhedron in the object.

5. The three dimensional space frame object of claim 1 wherein at least four joining members are present, each connecting three rod members at each of at least four different vertex points to form at least one twist-tetrahedron in the object.

6. The three dimensional space frame object of claim 1 wherein at least six joining members are present, each connecting four rod members at each of at least six different vertex points to form at least one twist octahedron in the object.

7. The three dimensional space frame object of claim 1 wherein at least eighteen rod members and at least sixteen joining members are provided by the kit, such that at least four to twelve twist polyhedra are formed in the object.

8. The three dimensional space frame object of claim 1 wherein the rod members are flexible and substantially cylindrical.

9. The three dimensional space frame object of claim 1 wherein at least some of the rod members are formed with a zig-zag configuration to avoid bending the rod members at vertex points.

10. The three dimensional space frame object of claim 1 wherein all of the rod members are formed with a zig-zag configuration to avoid bending the rod members at vertex points.

11. The three dimensional space frame object of claim 1 wherein at least one rod member extending from each vertex point is connected to at least two other rod members at another vertex point by at least one additional joining member.

12. The three dimensional space frame object of claim 1 wherein at least 20 to 25% of the total number of rod members extending from a vertex point in the space frame object are connected to at least two other rod members at each of at least two additional vertex points by at least one joining member at each additional vertex point to form multiple twist polyhedra in the object.

13. The three dimensional space frame object of claim 1 wherein the kit includes between 25 and 150 rod members and between 25 and 150 joining members.

14. The three dimensional space frame object of claim 1 wherein the rod members are made of plastic, metal or cane, have a circular, oval, rectangular or square cross-sectional area, and at least some of the rod members are a different color from the other rod members.

15. The three dimensional space frame object of claim 1 wherein the joining members comprise string, cord, elastic bands, clay, an adhesive or a plastic connector.

16. The three dimensional space frame object of claim 1 having a panel extending between the rod members on one or more faces of the object, wherein the panels are made of cardboard, plastic or fabric.

17. The three dimensional space frame object of claim 1 wherein each joining member is an adhesive.

18. A toy construction kit comprising:

a plurality of elongated rod members of different lengths; and a plurality of joining members, each configured and dimensioned for connecting at least three rod members together around a common vertex point in a weave pattern such that the rods pass by but do not pass through the vertex point and are oriented about the vertex point in a clockwise or counter clockwise arrangement;

wherein the rod members can be connected by the joining members to form three dimension space frame objects, and at least some of the rod members are formed with a zig-zag configuration to avoid bending the rod members at vertex points.

19. The toy construction kit of claim 18 wherein all of the rod members are formed with a zig-zag configuration to avoid bending the rod members at vertex points.

* * * * *